US009285131B2

(12) United States Patent
Brown

(10) Patent No.: US 9,285,131 B2
(45) Date of Patent: Mar. 15, 2016

(54) VENTING AND COOLING SYSTEM FOR A HOUSE

(76) Inventor: Kent L. Brown, Des Moines, IA (US)

( * ) Notice: Subject to any disclaimer, the term of this patent is extended or adjusted under 35 U.S.C. 154(b) by 1314 days.

(21) Appl. No.: 13/106,922

(22) Filed: May 13, 2011

(65) Prior Publication Data

US 2012/0289144 A1 Nov. 15, 2012

(51) Int. Cl.

| | |
|---|---|
| ***F24F 7/007*** | (2006.01) |
| ***F24F 13/30*** | (2006.01) |
| ***F24F 13/24*** | (2006.01) |
| ***F24F 5/00*** | (2006.01) |
| ***F24F 7/02*** | (2006.01) |
| *F23L 17/00* | (2006.01) |
| *F24F 3/06* | (2006.01) |

(52) U.S. Cl.

CPC ..... *F24F 7/007* (2013.01); *F24F 5/0003* (2013.01); *F24F 7/02* (2013.01); *F24F 13/24* (2013.01); *F23L 17/005* (2013.01); *F24F 3/06* (2013.01)

(58) Field of Classification Search

CPC ..... F24F 7/007; F24F 5/0003; F24F 7/02; F24F 7/025; F23L 17/005

USPC ..... 454/341

See application file for complete search history.

(56) References Cited

U.S. PATENT DOCUMENTS

| | | | | | |
|---|---|---|---|---|---|
| 36,059 | A * | 7/1862 | Muir | 454/241 |
| 832,247 | A * | 10/1906 | Edwards | 454/362 |
| 3,052,176 | A * | 9/1962 | Anderson | 454/253 |
| 3,557,681 | A * | 1/1971 | Kristiansen | 454/249 |
| 3,791,279 | A * | 2/1974 | Holt et al. | 250/384 |
| 4,134,545 | A * | 1/1979 | Westbrook | 237/53 |
| 4,144,802 | A * | 3/1979 | Babin | 454/353 |
| 4,200,035 | A * | 4/1980 | Zaniewski | 454/16 |
| 4,201,121 | A * | 5/1980 | Brandenburg, Jr. | 454/250 |
| 4,570,532 | A * | 2/1986 | Labelle | 454/234 |
| 4,641,571 | A * | 2/1987 | Anderson et al. | 454/19 |
| 4,671,350 | A * | 6/1987 | Toukola | 165/54 |
| 4,759,272 | A * | 7/1988 | Zaniewski | 454/344 |
| 4,949,625 | A * | 8/1990 | Miklos | 454/333 |
| 5,000,081 | A * | 3/1991 | Gilmer | 454/252 |
| 5,746,653 | A * | 5/1998 | Palmer et al. | 454/186 |
| 6,293,862 | B1 * | 9/2001 | Jafine et al. | 454/359 |
| 7,001,265 | B1 * | 2/2006 | Beaty | 454/345 |
| 7,685,943 | B2 * | 3/2010 | Caro et al. | 104/52 |
| 8,100,341 | B1 * | 1/2012 | Roderick et al. | 236/49.3 |
| 2008/0311842 | A1 * | 12/2008 | Alston et al. | 454/361 |
| 2011/0021134 | A1 * | 1/2011 | Zwern | 454/343 |
| 2011/0201264 | A1 * | 8/2011 | Hendrickson | 454/253 |

* cited by examiner

*Primary Examiner* — Steven B McAllister
*Assistant Examiner* — Frances F Hamilton
(74) *Attorney, Agent, or Firm* — Zarley Law Firm, P.L.C.

(57) ABSTRACT

A dwelling venting and cooling system that includes a set of side-by-side conduits wherein first and third conduits utilize a fan assembly that is actuated by wind power in order to vent hot air from an attic. The second conduit provides an electric fan that actuates the fan assemblies of the first and third conduits at times when wind is not sufficient to actuate the fan assemblies. The system further has attic air ducts that are in communication with vents in rooms within the dwelling in order to convey all hot air to the attic and out of the dwelling. In addition a cooling system that utilizes a water-to-air exchanger provides cool air into air ducts within the dwelling in order to replace the hot air with cool air.

10 Claims, 5 Drawing Sheets

VENTING AND COOLING SYSTEM FOR A HOUSE

BACKGROUND OF THE INVENTION

This invention relates to a house venting system. More specifically, this invention relates to a venting system that vents air from the attic and the dwelling.

For many years attic venting systems have been used in order to vent hot air out of an attic and into the atmosphere. Specifically, known in the art is that heat rises and thus in a home during hot months attics tend to hold a lot of heat. As a result of the attic holding heat the attic naturally warms the rest of the house causing air conditioners to work harder and more inefficiently in order to keep a dwelling cooled.

As a result of heat being captured in an attic, vent pipes are traditionally placed through the roof of a house in order to vent out the hot air. In this manner heat continues to rise and vents out of the house cooling the attic area. To improve upon the vent pipe those skilled in the art have added an attic fan that is used to convey air through the vent pipe.

While an attic fan does convey some heated air through a vent pipe in order to help solve the problem of the heated attic, many problems still remain. Specifically, problems with air movement still exist because an attic fan on its own is unable to convey hot air out of an attic fast enough to keep the attic sufficiently cool. Additionally, attic fans are typically noisy and can serve as an annoyance to home owners. In addition, at the present time in order to vent air from rooms of a house other than the attic requires unsightly duct work throughout the house.

Therefore, a principal object of the present invention is to provide a home venting system that improves upon the state of the art.

BRIEF SUMMARY OF THE INVENTION

A dwelling venting and cooling system that has a first conduit disposed through a roof of a dwelling and has an exhaust port for conveying air and a fan assembly that is actuated by air exterior to the dwelling to vent air out of the exhaust port. In side-by-side relation to the first conduit is a second conduit that has a closed end and an electric fan that through a plurality of openings can convey air to actuate the fan assembly of the first conduit to vent air out of the exhaust port. An attic air intake duct is then in communication with the first conduit and at least one room in the dwelling to communicate air from the room to the exhaust port.

DESCRIPTION OF THE PREFERRED EMBODIMENT

Figure 1:
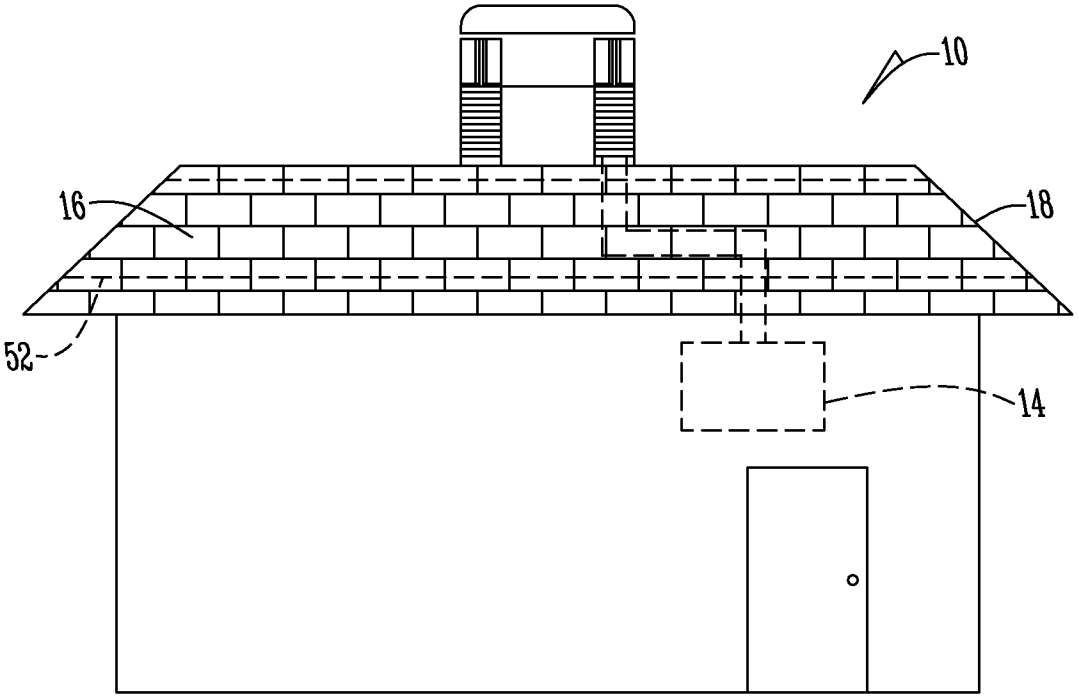
FIG. 1 is a side plan view of a venting an cooling system.
Figure 2:
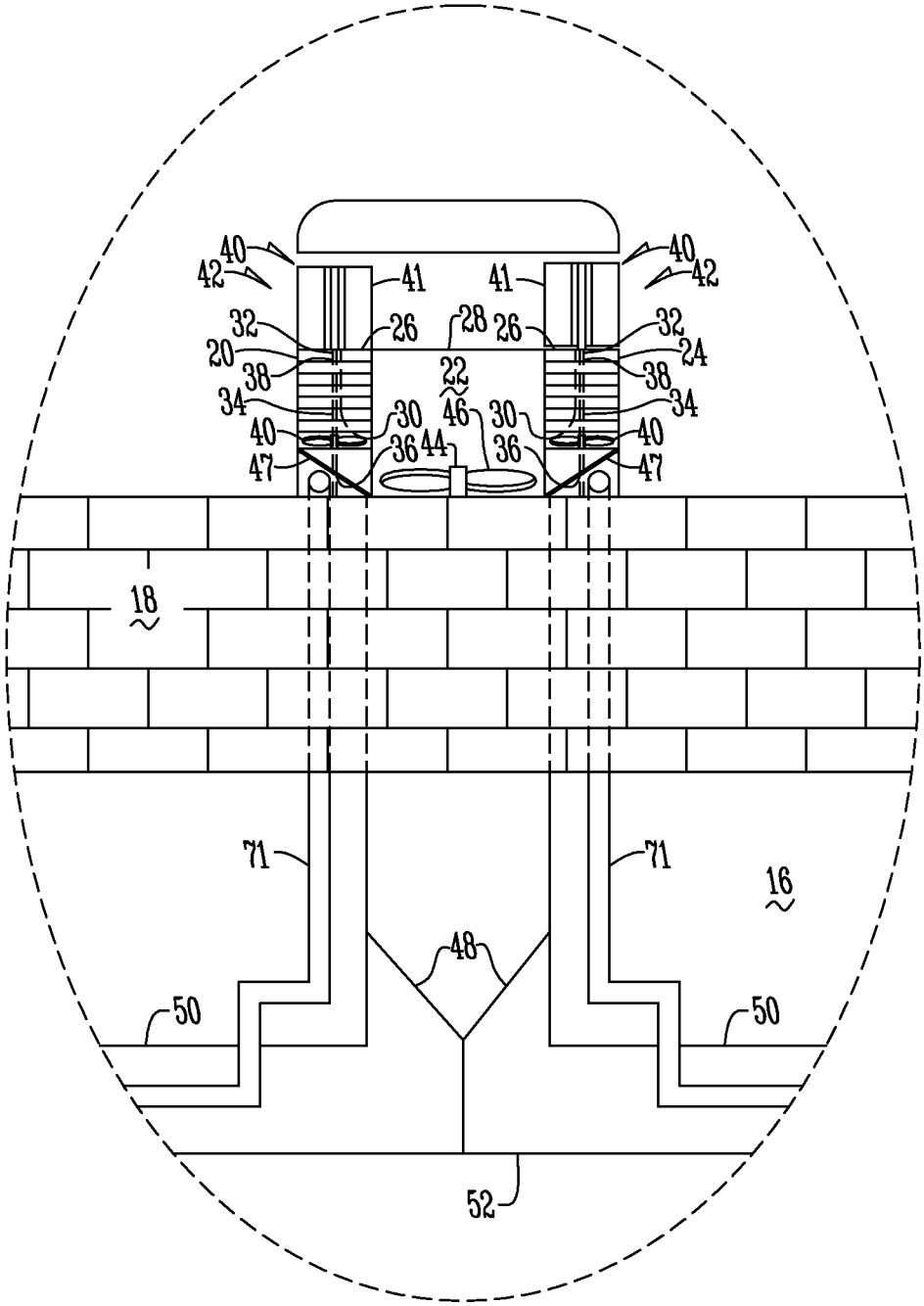
FIG. 2 is a side plan view of a portion of a venting and cooling system.
Figure 3:
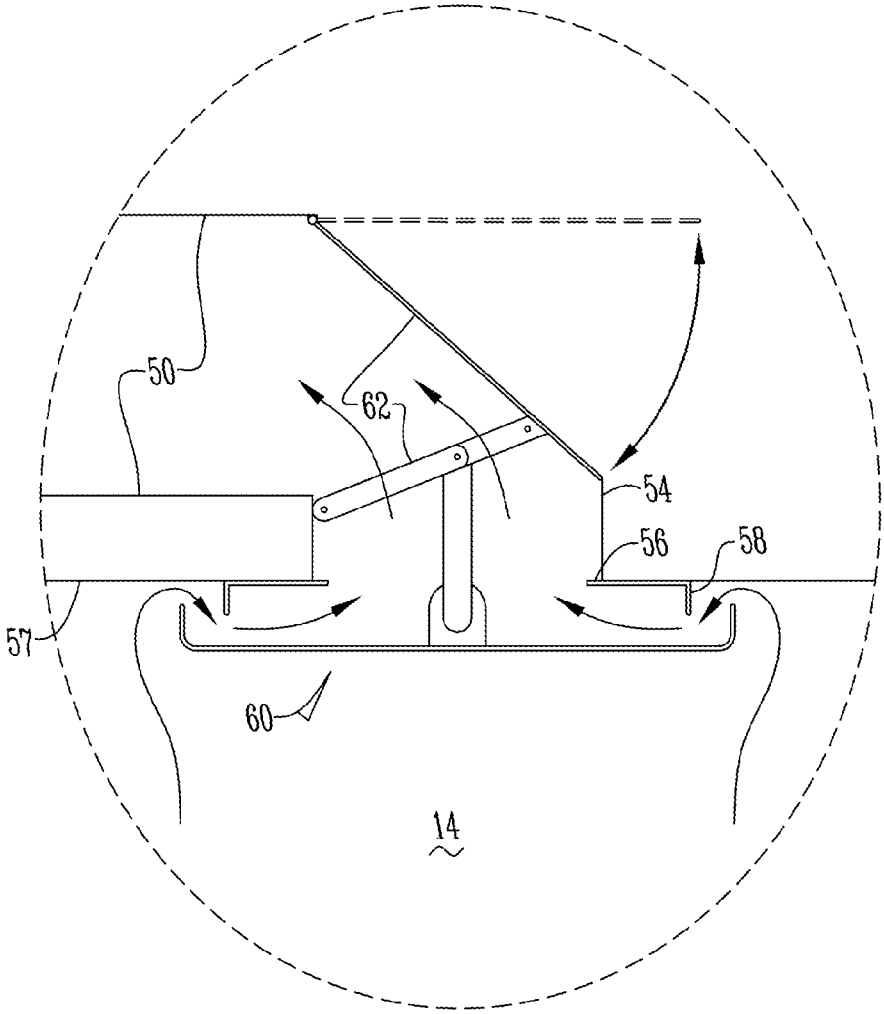
FIG. 3 is a cut away side plan view of a portion of a venting and cooling system.

The figures show a home venting and cooling system 10 used on a house or dwelling 12. The house or dwelling 12 has a plurality of rooms 14, an attic 16 and a roof 18. The home venting system 10 includes first, second and third side-by-side conduits 20, 22 and 24 that extend from within a home 12 through the roof 18 and to the exterior of the home 12. The three conduits 20, 22 and 24 are in parallel relation wherein the first and third conduits 20, 24 have open ends 26 to convey air from within the home or dwelling 12 to the exterior of the home or dwelling 12. The second conduit 22 meanwhile has a closed end or cap 28 exterior of the dwelling 12 and instead has openings 30 therein to convey and communicate air flow to the first and third conduits 20 and 24.

The first and third conduits 20 and 24 each have a plurality of louvers or exhaust ports 32 through which air is conveyed. In addition, the first and third conduits 20 and 24 have a shaft 34 disposed therein extending from a first to a second end 36 and 38 with a propeller 40 having blades 41 at each of the first and second ends 36 and 38 to form a fan assembly 42. Specifically, wind is conveyed onto the propellers 40 at the second end 38 to rotate each shaft 34. This rotates each fan assembly 42 at the first end 36 of each shaft 34 to draw air toward the first and third conduits 20 and 24 and out of the exhaust ports 32.

The second conduit 22 has an electric fan 44 with a propeller 46 disposed therein so that air can be conveyed through exhaust doors 47 within the second conduit 22 and through the openings 30 within the second conduit 22 onto the propellers 40 of the fans 42 at the first end 36 of the first and third conduits 20 and 24. Thus, the fan assemblies 42 within the first and third conduits 20 and 24 can either rotate in order to pull air to and through the conduits 20 and 24 out of the home via wind that blows the propeller 40 at the second end 38 of shaft 34 or alternatively by the movement of the air created by the electric fan 44 on the propeller 40 at the first end 36 of the shaft 34. Specifically, the electric fan 44 is utilized to supplement the force created by the wind. Additionally the second conduit has back draft doors 48 at its second end 38 that prevent back draft and are pulled open when the electric fan 44 operates.

Air ducts 50 that extend across a ceiling 52 of the attic 16 are in communication with the first and third conduits 20 and 24 to convey warm air to the conduits 20 and 24. In communication with the ducts 50 within the attic 16 is a room vent pipe 54 that provides a communication path between the ducts 50 and an opening 56 within a ceiling 57 in a room 14. In a preferred embodiment the opening 56 is covered by a vent 58 wherein a conventional ceiling fan 60 having a light bulb and shade is attached around the vent 58.

The vent 58 is operably connected to a valve 62 within an intersection between an attic air duct 50 and room vent pipe 54 so that when the vent 58 and valve 62 are closed, the airflow path from the attic is open to convey air from the duct 50 to the first and third conduits 20 and 24. When the vent 58 and valve 62 are open the valve 62 closes the attic air intake duct 50 and instead provides a flow path from within the room 14 to the first and third conduits 20 and 24. Thus, warm air at the ceiling 57 of room 14 is conveyed though the room vent pipe 54 and to the first and third conduits 20 and 24 to be expelled at the exterior of the house 12.

Figure 4:
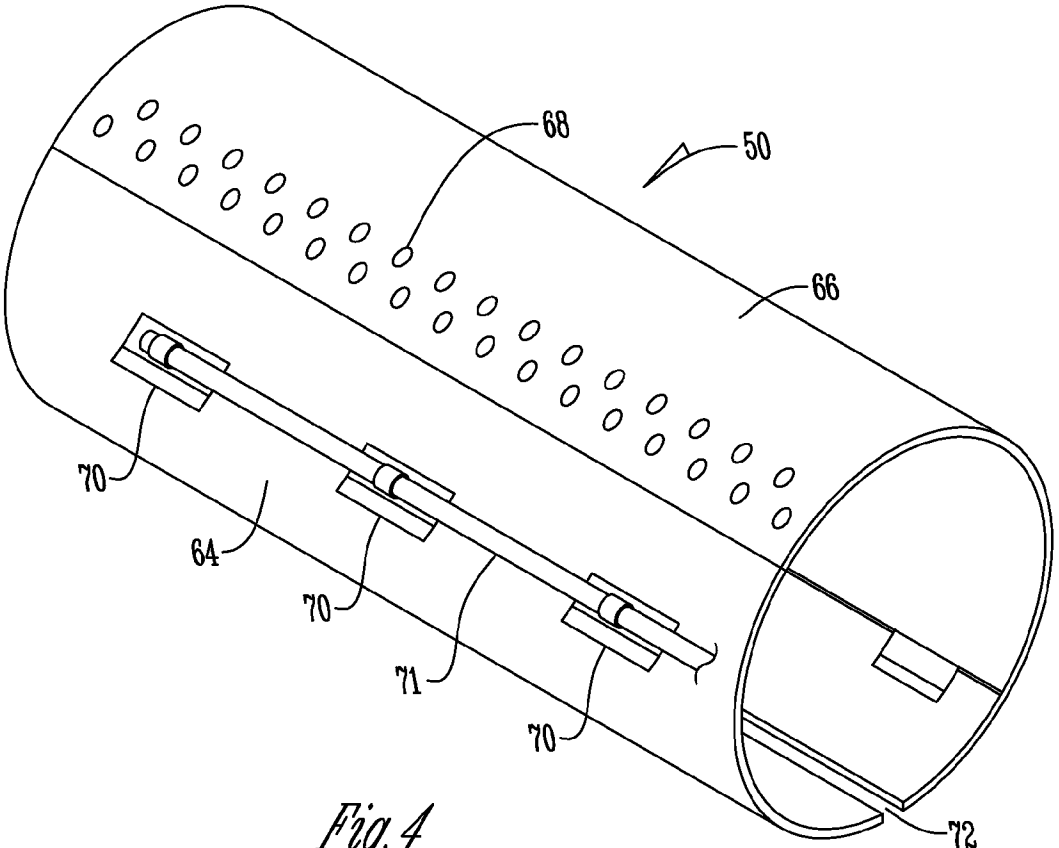
FIG. 4 is a side perspective view of an air intake duct of a venting and cooling system.

FIG. 4 shows an attic air duct 50. As one can see, the attic air duct 50 has a top portion 66 and a bottom portion 64 wherein the top portion 66 has a plurality of air inlets 68 to take in the hottest air from the attic 16. The ducts 50 additionally have a plurality of air intakes slots that can have doors 70 that are mechanically connected to the exhaust doors 47 of the second conduit 22 via linkage 71 so that when the electric fan 44 operates the exhaust doors 47 and duct doors 70 simultaneously open in order to intake additional air from the attic 16. In addition, the duct has a groove 72 at its bottom portion 64 such that dirt within the duct 50 falls out of the bottom of the duct 50 minimizing the dirt and damage to the system 10.

Figure 5:
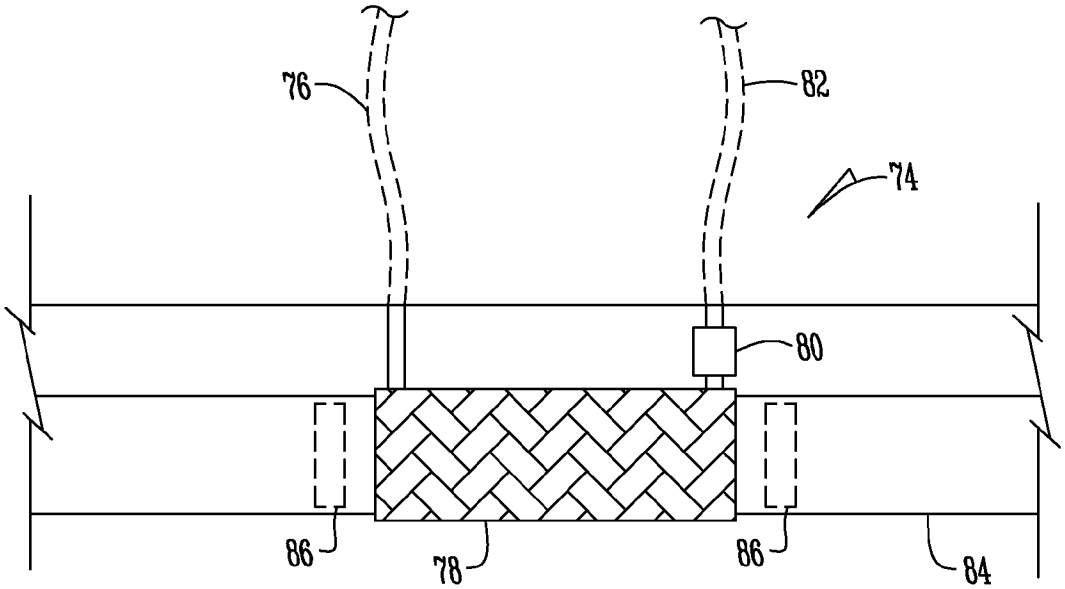
FIG. 5 is a side plan view of a venting and cooling system.

FIG. 5 shows a cooling system 74 utilized to provide cool air to the dwelling 12 in order to replace the hot air being vented by the venting and cooling system 10. The cooling system 74 utilizes water supplied by a city or well through an intake line 76 and inputs the input line 76 into a water-to-air exchanger 78 and then via a pump 80 returns the water through the water outline 82 of the home for recirculation. The water-to-air exchanger 78 converts the cold water into cooling air that then is conveyed to an air duct 84 that takes that air to different rooms 14 within the dwelling 12. Thus, the hot air that raises and is vented through the first and third conduits 20 and 24 is replaced with the cool air supplied by the cooling system 74. The cooling system can additionally include air filters 86 to filter such air.

In operation, as wind blows at the exterior of the house 12, wind flows to rotate the fan propellers 40 at the second end 38 of the shaft to rotate the propeller at the first end 36 of the shaft 34. This rotation causes air to be pulled from within the attic ducts 50 and conveyed out of the exhaust ports 32 to the exterior of the house 12. When the wind of the exterior of the house 12 is insufficient to move the fan propeller 40 at a desired rate the electric fan 44 is operated to provide an air flow that flows through the openings 30 within the second conduit 22 directly onto the propellers 40 of the first ends 36 of shafts 34 within the first and third conduits 20 and 24 to rotate the shafts 34 accordingly. By operating the fan 44 the back draft doors 48 are sucked open and the exhaust doors 47 similarly open causing duct doors 70 also to open to improve efficiency.

When air in a room 14 is desired to be vented, an individual merely needs to open a vent 58 in the room 14. By opening the vent 58 a valve 62 closes the attic air intake ducts 50 from the first and third conduits 20 and 24 and provides a communication flow path from the ceiling 57 of the room 14 to the first and third conduits 20 and 24. Once the room is at a sufficient temperature the vent 58 is closed causing the valve 62 to reopen the flow path from the attic air ducts 50 to the first and third conduits 20 and 24.

When the hot air is thus conveyed from a room 14 to the first and third conduits 20 and 24 the air may then be replaced with air from the cooling system 74. The cooling system 74 receives water from a water inlet 76 and a water-to-air exchanger 78 converts the temperature of the water to the air temperature within a duct 84 to supply cool air into room 14.

Thus, provided is a home venting system 10 that utilizes wind energy and a small electric fan 44 to convey air from an attic 16. This reduces the amount of noise generated by a traditional fan used to convey air from an attic 16 and provides improved air movement. In addition, by utilizing the room vent pipe 54 in a vent 58, an air path is provided to vent air from a room 14 to the exterior of the house 12 without having to present undesirable aesthetically displeasing duct work within a room.

It will be appreciated by those skilled in the art that other various modifications could be made to the device without departing from the spirit and scope of this invention. All such modifications and changes fall within the scope of the claims and are intended to be covered thereby.

What is claimed is:

1. A dwelling venting and cooling system comprising:

a first conduit disposed through a roof of a dwelling having an exhaust port for conveying air and a fan assembly that is actuated by air exterior to the dwelling to vent air out of the exhaust port;

a second conduit in side-by-side relation with the first conduit having a closed end exterior the dwelling, an electric fan and a plurality of openings to convey air to actuate the fan assembly of the first conduit; and an attic air intake duct in communication with the first conduit and at least one room of the dwelling to communicate air from the room to the exhaust port of the first conduit.

2. The system of claim 1 further comprising a third conduit in side-by-side relation with the second conduit having an exhaust port for conveying air and a fan assembly that is actuated by air exterior of the dwelling and air conveyed by the electric fan of the second conduit to vent air out of its exhaust port.

3. The system of claim 1 wherein the air intake duct has a plurality of openings on a top surface for intaking air from within an attic.

4. The system of claim 3 wherein the air intake duct has a plurality of inlet doors therein that open to convey additional air to the first conduit.

5. The system of claim 3 wherein the air intake duct has a groove in a bottom surface.

6. The system of claim 1 wherein a ceiling in the room has a room vent pipe that is in communication with the attic air intake duct.

7. The system of claim 6 wherein a valve is disposed between the attic air duct and room vent pipe such that when the valve closes, a flow path from within the room to the exhaust port of the first conduit is formed.

8. The system of claim 1 further comprising an air cooling system having a water-to-air exchanger in communication with water coming into the dwelling to communicate air into an air duct in the dwelling.

9. The system of claim 8 wherein the air duct has a filter therein.

10. A dwelling venting and cooling system comprising:

a first conduit disposed through a roof of a dwelling having an exhaust port for conveying air and a fan assembly that is actuated by air exterior to the dwelling to vent air out of the exhaust port;

the fan assembly having a shaft extending from a first end and a second end of the first conduit and a propeller on the shaft at the first end and second of the first conduit;

a second conduit in side-by-side relation with the first conduit having a closed end exterior the dwelling, an electric fan and a plurality of openings to convey air to actuate the fan assembly of the first conduit; and an attic air intake duct in communication with the first conduit and at least one room of the dwelling to communicate air from the room to the exhaust port of the first conduit.

* * * * *